United States Patent [19]

Prater

[11] Patent Number: 4,738,365

[45] Date of Patent: Apr. 19, 1988

[54] FROZEN FOOD CONTAINER

[75] Inventor: Donald R. Prater, Beaverton, Oreg.

[73] Assignee: Ridgway Packaging Corp., Redmond, Wash.

[21] Appl. No.: 42,680

[22] Filed: Apr. 27, 1987

[51] Int. Cl.[4] ..... B65D 5/54

[52] U.S. Cl. ..... 206/625; 53/456; 53/471; 206/607; 206/634; 229/123.3; 229/125.32; 229/125.33; 426/107; 426/122; 493/102; 493/133

[58] Field of Search ..... 206/607, 608, 611, 625, 206/626, 628, 634; 229/23 BT, 43, 145, 903, 123.3, 125.32, 125.33; 53/456, 471, 478; 493/58, 102, 133, 135; 426/107, 122, 123, 234

[56] References Cited

U.S. PATENT DOCUMENTS

| | | | |
|---|---|---|---|
| 1,302,361 | 4/1919 | Gordon | 229/33 |
| 2,085,680 | 6/1937 | Grace, Jr. | 229/51 |
| 2,461,251 | 2/1949 | Ball et al. | 229/137 |
| 2,661,890 | 12/1953 | Stastny et al. | 229/23 R |
| 2,677,493 | 5/1954 | Wauda | 229/195 |
| 2,928,581 | 3/1960 | Graybill | 229/39 R |
| 2,973,086 | 2/1961 | Thompson | 206/607 |
| 3,140,037 | 7/1964 | Baum et al. | 229/43 |
| 3,167,238 | 1/1965 | Smith | 229/51 |
| 3,313,469 | 4/1967 | Drozda | 229/38 |
| 3,322,324 | 5/1967 | Persson | 229/38 |
| 3,361,328 | 1/1968 | Buttery | 229/37 R |
| 3,362,614 | 1/1968 | Farquhar | 229/137 |
| 3,377,767 | 4/1968 | Franz | 53/467 |
| 3,399,820 | 9/1968 | Foster et al. | 229/37 R |
| 3,438,566 | 4/1969 | Mahon | 229/137 |
| 3,521,812 | 7/1970 | Moers et al. | 229/138 |
| 3,572,576 | 3/1971 | Foster | 229/31 |
| 3,580,466 | 5/1971 | Thelen et al. | 229/17 |
| 3,603,502 | 9/1971 | Howard | 229/45 R |
| 3,661,321 | 5/1972 | Tessmer, Jr. | 229/17 R |
| 3,786,983 | 1/1974 | Hennessey | 206/628 |
| 3,812,641 | 5/1974 | Bemiss | 53/14 |
| 3,905,646 | 9/1975 | Brackmann et al. | 229/23 R |
| 3,927,505 | 12/1975 | Bemiss | 53/471 |
| 4,003,514 | 1/1977 | Graser | 229/34 HW |
| 4,043,503 | 8/1977 | Meyers et al. | 206/613 |
| 4,053,103 | 10/1977 | Gaudish | 229/138 |
| 4,158,412 | 6/1979 | Wysocki | 206/628 |
| 4,197,962 | 4/1980 | Edwards | 220/461 |
| 4,361,266 | 11/1982 | Killy | 229/43 |
| 4,449,633 | 5/1984 | Johnson | 206/612 |
| 4,613,046 | 9/1986 | Kuchenbecker | 206/622 |
| 4,687,104 | 8/1987 | Ielmini | 206/628 |

FOREIGN PATENT DOCUMENTS

| | | | |
|---|---|---|---|
| 1079240 | 6/1980 | Canada | 206/626 |
| 1514373 | 1/1968 | France | 229/43 |
| 1009558 | 5/1957 | German Democratic Rep. | 206/625 |
| 318819 | 12/1969 | Sweden | 206/612 |
| 279927 | 10/1927 | United Kingdom | 206/607 |
| 489677 | 8/1938 | United Kingdom | 206/607 |
| 1150962 | 5/1969 | United Kingdom . | |
| 1584147 | 2/1981 | United Kingdom . | |

*Primary Examiner*—Stephen Marcus
*Assistant Examiner*—Gary E. Elkins
*Attorney, Agent, or Firm*—Christensen, O'Connor, Johnson & Kindness

[57] ABSTRACT

A container for storing a product and for holding it while it is heated in a microwave or a conventional oven. The container includes a tray-like box portion that is adherently sealed and secured inside a leakproof cover. A panel of the tray-like box has a tear-open access flap which may be tightly reclosed after being torn open and which is held in place by an interference fit between two spaced apart shoulders defined along a fold line where the access flap is joined to a reclosure tab. The panel of the tray-like box is imprinted with the instructions for heating the product enclosed within the container, while the cover is imprinted with graphics. The container is turned over during the heating process, so the instructions are visible to the consumer. Tight reclosure of the access flap tends to retain steam inside the container during the heating process thereby reducing the cooking time and retaining moisture in the product.

19 Claims, 6 Drawing Sheets

Fig. 12.
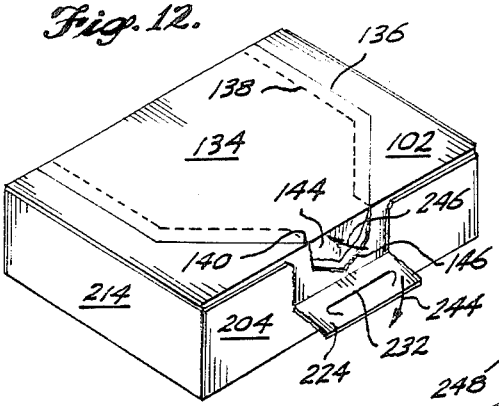
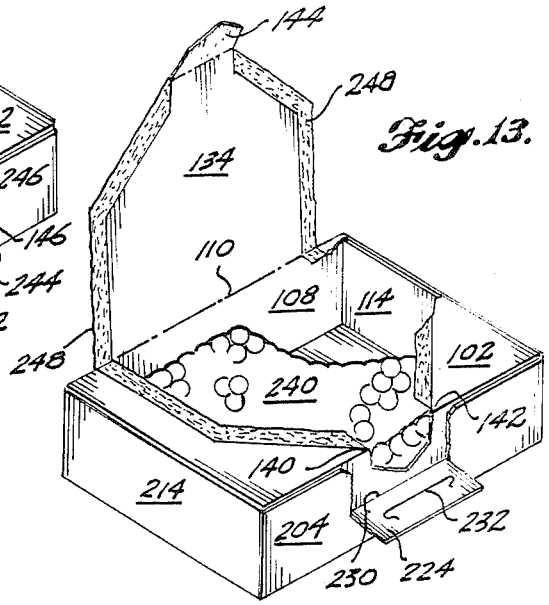
Fig. 13.
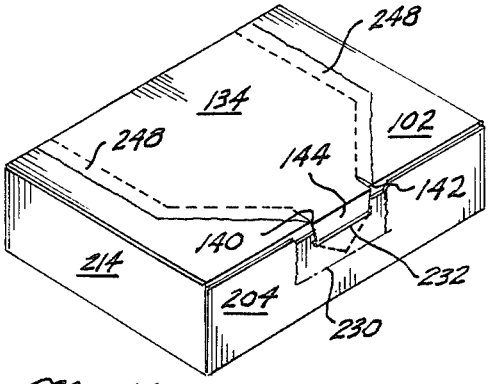
Fig. 14.
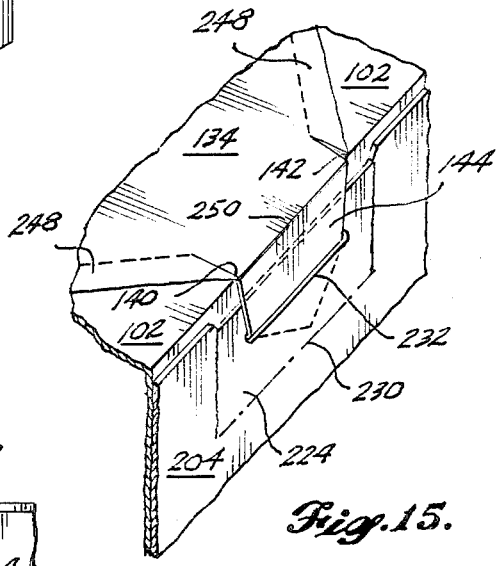
Fig. 15.
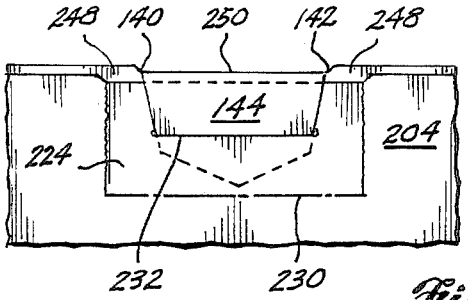
Fig. 16.

FROZEN FOOD CONTAINER

TECHNICAL FIELD

This invention generally pertains to a top filled microwavable or ovenable container, and specifically to such containers having tear-open flaps providing access to a product enclosed therein.

BACKGROUND ART

Frozen food containers are often marketed in cartons constructed from unitary blanks comprising waterproof paperboard having flaps that are folded and sealed to insure product freshness. In response to the growing demand for convenience foods and the popularity and ready availability of microwave ovens for quickly heating such foods, containers have been developed that may be taken directly from the freezer and heated in a microwave (or conventional) oven. Most such containers are folded from a paperboard blank that includes gusseted corners so that the bottom of containers thus constructed forms a leakproof tray. After the container is filled with the product through the open top, the top is closed and sealed along the sides.

The instructions for heating some food products require that the consumer open the container by pulling back a tear-open flap either prior to or during the heating process to expose the product and/or to permit water, butter or seasoning to be added. The tear-open flap may be partially reclosed by inserting a tab on the end of the flap into a slot provided on a side of the container. Due to the design of prior art containers of this type, the tear-open flap cannot be fully reclosed; a wedge-shaped gap remains between the top and the access flap when the tab is fully inserted into the slot. Steam may escape through this gap when the product is heated. Although certain products may require that steam be allowed to escape while being heated, for the majority of food products, it is desirable to more tightly reclose the flap so that steam trapped within the container more quickly cooks the product.

When frozen food containers are displayed to the consumer for sale in a supermarket, it is a common practice to present a graphic representation of the product enclosed in the container imprinted on the top surface and sides. Heating instructions are normally relegated to the bottom surface of the container. The tear open panel is on the top surface of such containers, and thus the container is placed in an oven to heat its contents with the instructions facing downwardly. Prior to opening the package or initiating the heating process, the consumer may freely turn the container over to read the instructions without any adverse consequences. However, once the product is heated so that it is partially thawed and/or the top of the package is opened, reference to the instructions printed on the bottom may require holding the container high overhead, risking spillage of the contents. Since multiple microwave oven power levels and time levels are often required to cook food products, the need to refer to instructions during the heating process may frequently arise.

It may seem relatively trivial to correct the problem associated with placement of heating instructions on the bottom of the container, but this is not the case with prior art packaging. Conventional microwavable/ovenable containers of necessity must have a leakproof portion on the bottom during the heating process. Flaps on the top portion overlap the outside of the bottom portion on at least three sides. It is not practical to merely interchange the surfaces on which the graphics and instructions are normally imprinted on such a container, since the raw edges of the flaps would be exposed if the container were thus inverted, reducing product marketability. Marketing considerations thus dictate the need to imprint the graphics on the top surface and the instructions on the bottom surface of conventional containers.

In consideration of the problems represented by prior art food packaging containers as described above, it is a primary object of this invention to provide a top filled container useful for heating the product enclosed therein in a microwave or conventional oven and having an access flap which may be tightly reclosed after being opened by a consumer.

Further objects of this invention are to provide a top filled container that may be tightly reclosed for storage of an unused portion of the product, preventing it from drying out; to provide such a container which when reclosed, is easier to handle with less chance of spilling its contents; to provide such a container in which food may be cooked more rapidly than in conventional containers which tend to vent excessive amounts of steam from the product; and to provide a container with more conventiently displayed cooking instructions and with graphics covering a smooth top surface and side panels.

These and other objects of the invention will be apparent to those of ordinary skill in the art to which this invention pertains, by reference to the attached drawings and the disclosure of the preferred embodiment that follows hereinbelow.

SUMMARY OF THE INVENTION

The present invention is a container used for storing a product and adapted to hold the product while it is heated in an oven. The container includes a first panel having an inner surface and an outer surface, and four edges, each of which is defined by a fold line. The first panel is connected along different fold lines to a first and a second side flap at two opposite edges of the panel, and to a first and a second end flap which are disposed along two other edges. The first and second side flaps and end flaps are all folded along the fold lines so that they are generally normal to the inner surface of the first panel, and the side flaps are securedly attached to the end flaps to define a tray-like box.

The first panel further includes a tear-open access flap that is defined by a pair of partially die cut lines that extend across the panel in generally parallel alignment. These partially die cut lines terminate at two spaced apart points disposed along one of the fold lines defining the edges of the first panel. Coterminous with the two spaced apart points are ends of a perforation line that defines a reclosure tab disposed on one of the first and second side flaps and the first and second end flaps.

Also included in the container is a second panel having an inner surface and an outer surface, and four edges, each of which is defined by a fold lines to each of a first and a second sidewall at opposite edges of the second panel, and to each of a first and second end wall along two other edges thereof. The first and second sidewalls and the first and second end walls are all folded along the fold lines so that they are generally normal to the inner surface of the second panel. The first and second end walls are connected to the first and second sidewalls by four gusseted corners that are folded inwardly of the sidewalls and the end walls and adherently secured and sealed in place. A generally leakproof cover is thus defined by the second panel, the first and second sidewalls and end walls, and the gusseted corners.

After one of the tray-like box and leakproof cover is filled with the product, the leakproof cover is fitted over the tray-like box, with the outer surface of the first and second end flaps being adherently secured and sealed to the inner surfaces of the corresponding first and second end walls, respectively. Likewise, the outer surface of the first and second side flaps is adherently secured and sealed to the inner surface of the corresponding first and second sidewalls, respectively.

A slotted tab receiver is defined in one of the first and second end walls and the first and second sidewalls by a pair of perforation lines and a scored fold line. The slotted tab receiver overlies the reclosure tab and includes a slot for receiving the reclosure tab upon reclosure of the access flap after it is opened.

The two points at which the partially die cut lines terminate define a first and a second shoulder. After being opened, the access flap fits between the first and second shoulders in an interference fit upon its reclosure, so that friction between the access flap and the first and second shoulders holds the access flap in close sealing contact with the first panel.

BRIEF DESCRIPTION OF THE DRAWINGS

FIG. 12 is a perspective view of the container illustrating the initial steps required to open the tear-open access flap.

FIG. 13 illustrates in a partially cutaway perspective view the container and enclosed product after the access flap has been torn open.

FIG. 14 is a perspective view showing the container following reclosure of the access flap.

FIG. 15 is an enlarged, cutaway perspective view of the portion of FIG. 14 showing a reclosure tab engaged in a slot on a side of the container.

FIG. 16 is an enlarged elevational view of the reclosure tab engaged in the slot as shown in FIGS. 14 and 15.

DETAILED DESCRIPTION OF THE PREFERRED EMBODIMENT

Figure 1:
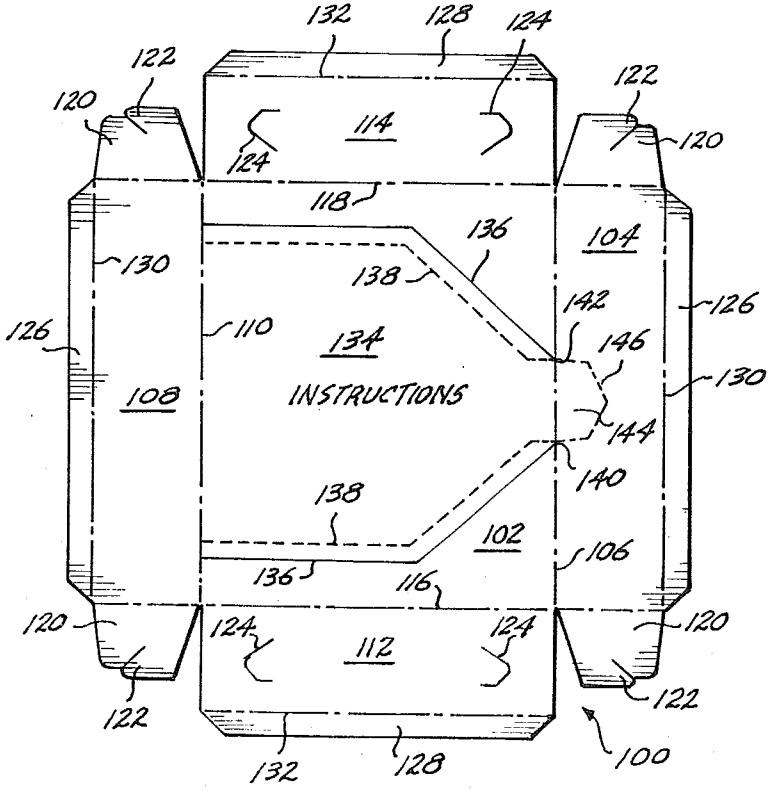
FIG. 1 is a plan view of an unfolded blank used to construct a tray-like box portion of the container.

Referring to FIG. 1, a pre-cut blank 100 is shown as it is initially stamped from paperboard coated with polyethylene plastic or other waterproof material suitable for use in a microwave oven (or with polyester plastic or other waterproof material suitable for use in either a microwave or a conventional oven). A second precut blank 200 shown in FIG. 2 comprises a similar material; those skilled in the art will understand that the coating selected for pre-cut blanks 100 and 200 will depend on the intended use of the resulting container.

Pre-cut blank 100 is folded to form a tray-like box as will be hereinafter described. As shown in FIG. 1, the outer surface of pre-cut blank 100 is facing upwardly, the surface shown normally being imprinted with instructions for heating a product which will be enclosed in the resulting container.

Pre-cut blank 100 includes a first panel 102 which may be either square, or rectangular as shown in FIG. 1. A first side flap 104 is attached to first panel 102 along a scored fold line 106. Similarly, a second side flap 108 is appended to first panel 102 along scored fold line 110 at an opposite edge thereof. First and second end flaps 112 and 114 are appended at opposite ends of first panel 102 along scored fold lines 116 and 118, respectively. Scored fold lines 116 and 118 extend across the ends of side flaps 104 and 108 to define corner flaps 120 that are appended to each end of the side flaps. Corner flaps 120 each include a corner tab 122 that is adapted to engage a corner slot 124 disposed on each of first and second end flaps 114 at positions generally inset from the ends thereof. Each of side flaps 104 and 108 include a relatively narrow stiffener flap 126 extending along their outer edge and appended thereto along scored fold lines 130. Likewise, end flaps 112 and 114 include stiffener flaps 128 appended along their outer edges along scored fold lines 132. The purpose of stiffener flaps 126 and 128 will become apparent in the description that follows.

A tear-open access flap 134 is defined on first panel 102 by a pair of partially die cut (or "reverse cut") lines 136 and 138 that extend from fold line 110 toward the opposite side of the first panel, terminating at points 140 and 142 along fold line 106. Partially die cut lines 136 and 138 are generally parallel, except where they converge to meet at points 140 and 142. In FIG. 1, partially die cut line 136 is shown as a solid line to indicate that it is partially cut through the exposed outer surface of first panel 102, whereas partially die cut line 138 is shown as a dash line to indicate that it is partially die cut through the nonexposed inner surface of first panel 102. A reclosure tab 144 is disposed on side flap 104 and is defined by a perforation line that extends from point 140 to point 142. It will be apparent that the access flap could be defined by partially die cut lines that extend from the fold line defining an end wall to the opposite end wall, e.g., from fold line 116 to fold line 118. Further, the reclosure tab could be defined by a perforation line on the end flap, e.g., end flap 114, thereby providing an "end opening access flap" and "end reclosure tab" fully analogous in form and function to access flap 134 and reclosure tab 144.

Figure 2:
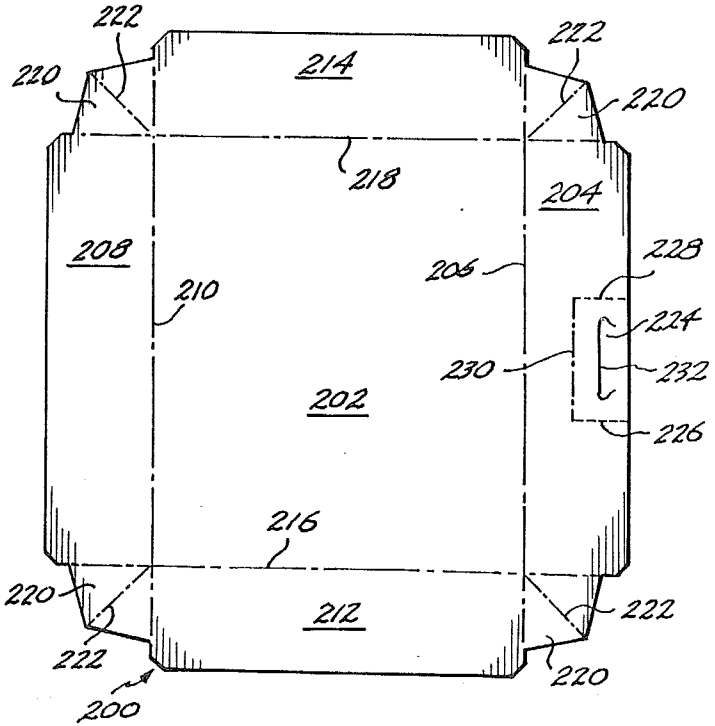
FIG. 2 is a plan view of an unfolded blank representing a leakproof cover of the container.

Turning now to FIG. 2, second pre-cut blank 200 includes a second panel 202 which is also either square, or rectangular as shown in FIG. 2, and which is in any case, approximately the same size as first panel 102. Appended along one edge of second panel 202 is first sidewall 204, defined by a fold line 206. On the opposite edge of the second panel 202 is appended a second sidewall 208, defined by fold line 210. First and second end walls 214 and 212 are attached to opposite ends of second panel 202 along fold lines 218 and 216, respectively. Gusseted corners 220 connect adjacent ends of sidewalls 204 and 208 and end walls 212 and 214. Fold lines 222 generally bisect gusseted corners 220, intersecting each of fold lines 206, 210, 216 and 218 at approximately a 45 degree angle.

When folded and constructed as will be hereinafter described, second pre-cut blank 200 comprises a generally leakproof cover that is used in conjunction with the tray-like box constructed from pre-cut blank 100. As shown in FIG. 2, the inner surface of the resulting leakproof cover formed from pre-cut blank 200 is shown facing upwardly.

A tab receiver 224 is disposed in first sidewall 204 and is defined by perforation lines 226 and 228 that extend along its opposite edges, and by scored fold line 230. Tab receiver 224 includes slot 232 that is generally disposed in a position intermediate to each end of first sidewall 204. The function of tab receiver 224 will become apparent from the description hereinbelow. If an "end opening access flap" is used, the tab receiver may be disposed on the end wall 212 or 214 corresponding to the end flap 112 or 114 on which the reclosure tab is defined.

Figures 3, 4:
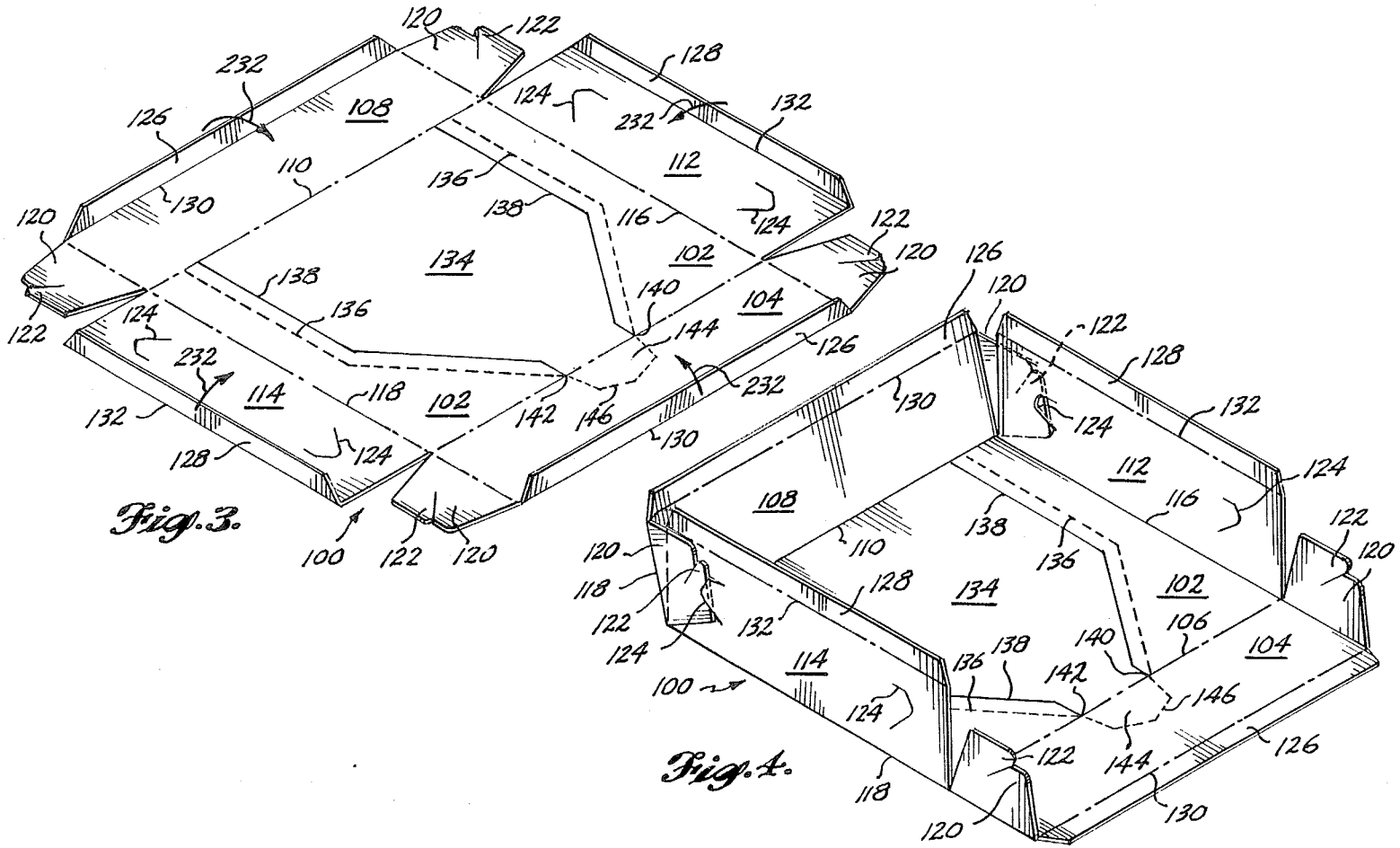
FIG. 3 illustrates in a perspective view, the initial steps taken in folding the blank shown in FIG. 1 to form a tray-like box.
FIG. 4 is a perspective view of the tray-like box illustrating the manner in which tabs on the side flaps are interlocked with slots on the end flaps.

The first steps required in forming pre-cut blank 100 into a tray-like box are illustrated in FIG. 3. As shown therein, stiffener flaps 126 and 128 along the respective sideflaps 104 and 108 and end flaps 112 and 114 are temporarily folded generally transverse to the planar surface of pre-cut blank 100 in the direction of arrows 232 in a "pre-break" fold. This pre-break fold enables the stiffener flaps to be easily turned over during the later final assembly of the container. Stiffener flaps 126 and 128 provide rigidity to each of side flaps 104 and 108 and end flaps 112 and 114 in the assembled container. Following the pre-break fold, the stiffener flaps unfold.

Referring now to FIG. 4, end flaps 112 and 114 are shown after being folded upwardly along fold lines 116 and 188, respectively, so that they are generally transverse to the inner surface of first panel 102. Subsequently, second side flap 108 is also folded upwardly in the direction indicated by arrow 234, while corner flaps 120 disposed at each of its ends are folded inwardly so that they are adjacent the outer surface of end flaps 112 and 114. As second side flap 108 is folded upwardly, corner tabs 122 on each of its corner flaps 120 are caused to engage adjacent slots 124 disposed on end flaps 112 and 114, thereby securing second side flap 108 in place. Similarly, the corner flaps 120 on each end of first side flap 104 are folded upwardly, transverse to its inner surface, and the side flap is itself folded upwardly while corner tabs 122 are caused to engage adjacent slots 124, thereby securing first side flap 104 in position.

Figure 5:
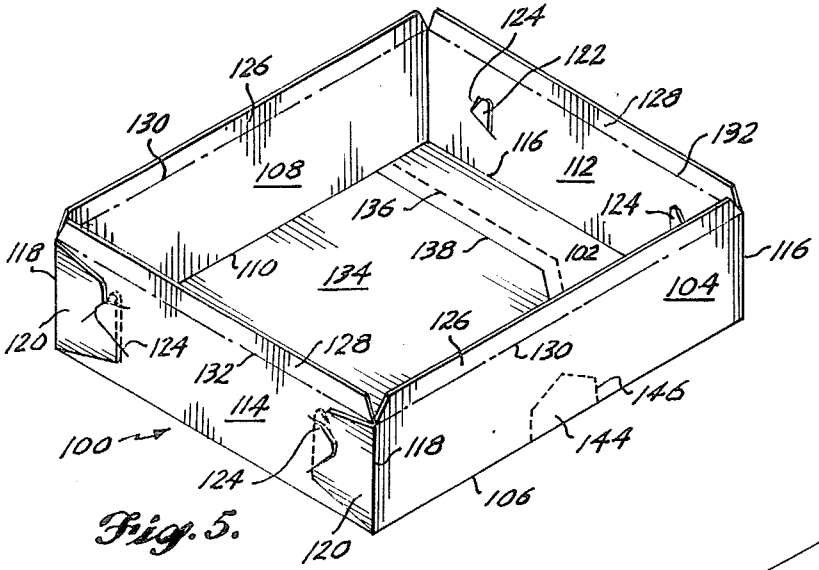
FIG. 5 is a perspective view illustrating the tray-like box constructed from the blank shown in FIG. 1.
Figure 6:
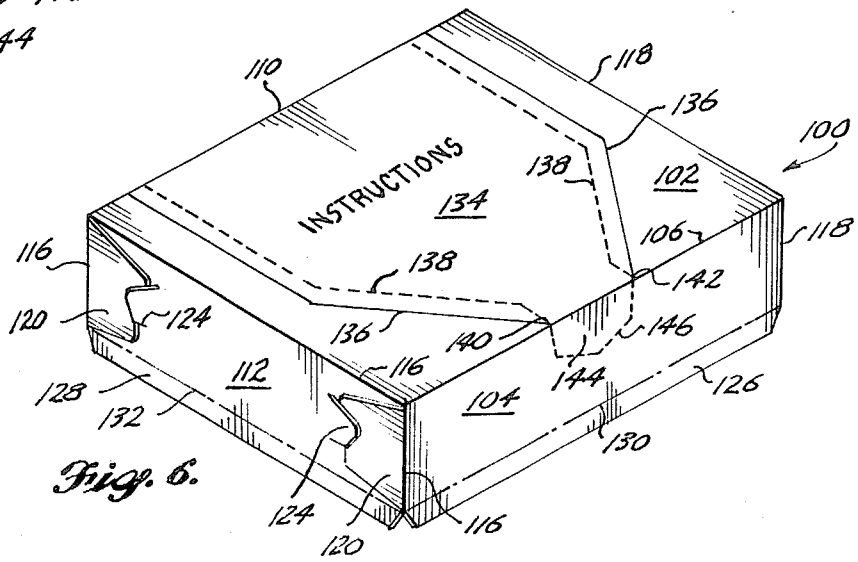
FIG. 6 is a perspective view showing the opposite surface of the tray-like box illustrated in FIG. 3.

The resulting tray-like box resulting from the assembly process just described is illustrated in two views, in FIGS. 5 and 6. Although the preferred embodiment uses corner tabs 122 engaged in slots 124 to secure side flaps 104 and 108 to end flaps 112 and 114, those skilled in the art will also appreciate that corner flaps 120 could be adherently secured to end flaps 112 and 114, without the use of the slot and tab arrangement shown in the preferred embodiment. It should also be apparent that corner flaps 120 could also be appended to the ends of end flaps 112 and 114 and folded to engage slots 124 that are instead disposed on side flaps 104 and 108 in a manner generally analogous to that which has already been described and illustrated for the preferred embodiment of FIGS. 5 and 6.

Figure 7:
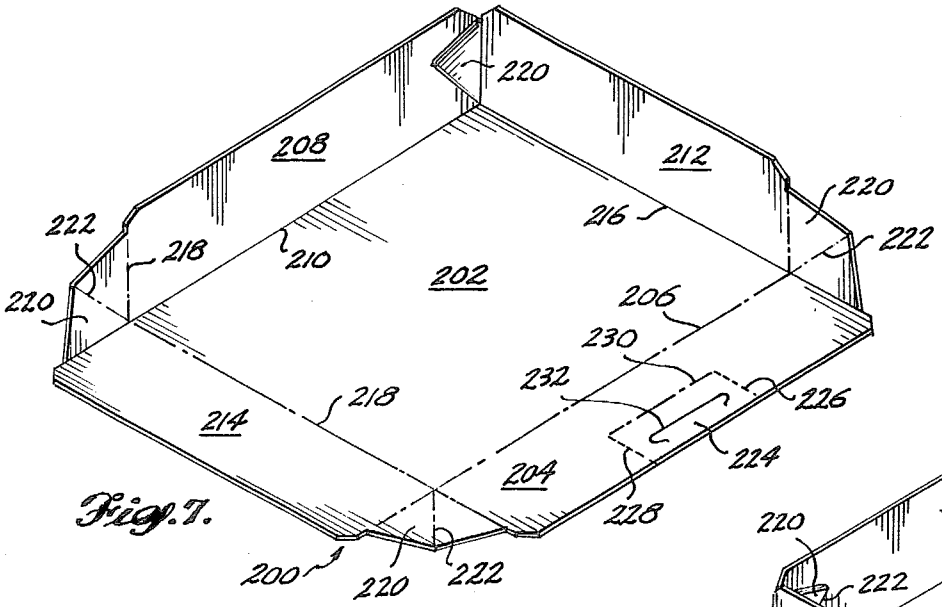
FIG. 7 is a perspective view of the cover portion of the invention, illustrating the manner in which a first gusseted corner is folded.
Figure 8:
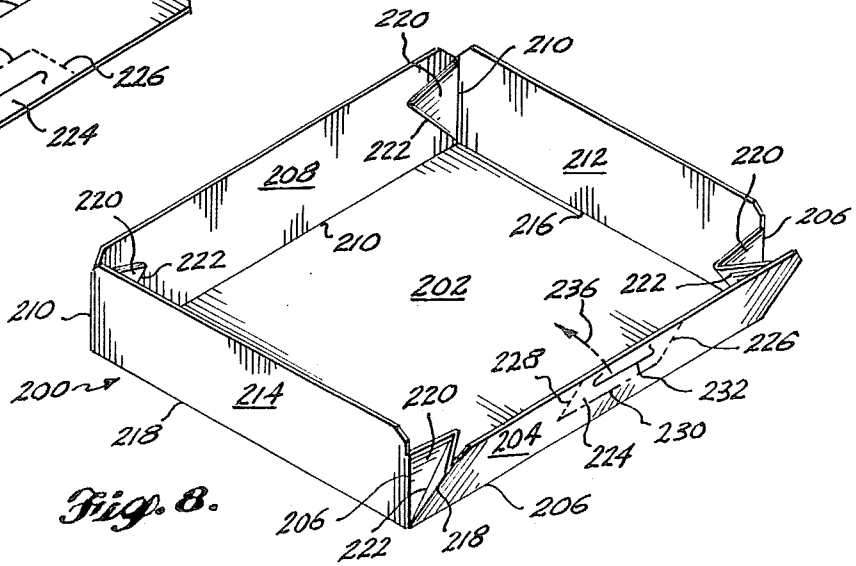
FIG. 8 is a perspective view showing further steps in the construction of the cover portion.
Figures 9, 10, 11:
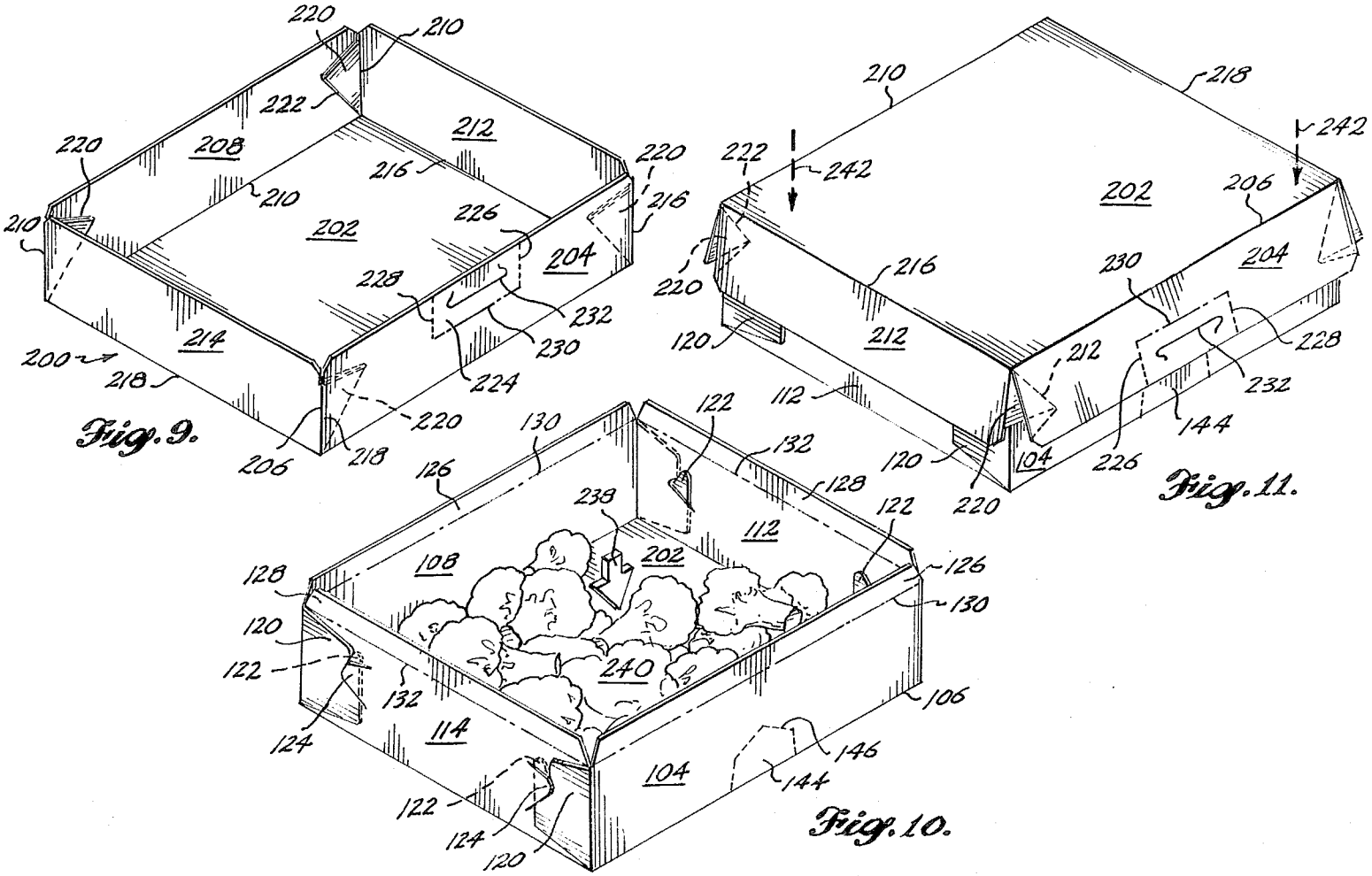
FIG. 9 is a perspective view showing the completed cover portion.
FIG. 10 shows in a perspective view the manner in which the tray-like box is filled with a product to be enclosed within the container.
FIG. 11 illustrates in a perspective view the manner in which the cover portion is fitted over the tray-like box.

A gusseted corner folding operation for constructing a leakproof cover from leakproof blank 200 is shown in FIG. 7. FIGS. 7–9 illustrate the entire folding sequence as a series of steps; however in actual practice, blank 200 is actually folded over the top of the tray-like box in fewer steps. The tray like box thus serves as a form for folding the cover. As illustrated, second end wall 212 is folded along fold line 216, so that it is generally transverse to second panel 202 and second sidewall 208 is folded along fold line 210, so that it is also transverse to the inner surface of second panel 202. The gusseted corner 220 disposed between second end wall 212 and second sidewall 208 is folded inwardly along fold line 222.

Referring now to FIG. 8, second pre-cut blank 200 is shown after first end wall 214 is folded upwardly along fold line 218, so that it is transverse to the inner surface of second panel 202. During that construction step, the gusseted corner 220 disposed between second sidewall 208 and first end wall 214 is folded inwardly along fold line 222. The manner in which the gusseted corners 220 are folded inwardly along fold lines 222 as first sidewall 204 is folded upwardly along fold line 206, in the direction indicated by arrow 236 is clearly illustrated in FIG. 8.

After second pre-cut blank 200 has been folded over the tray-like box described hereinabove, the generally leakproof cover shown in FIG. 9 is provided by thermally sealing and securing each of the four gusseted corners 220 in place adjacent the inner surface of sidewalls 204 and 208 as shown in FIG. 9. Corners 220 may instead be sealed against end walls 212 and 214. An electric hot air blower or gas-fired heat sealing system is typically used for thermally bnonding and sealing such flaps together by thermally melting the coating that is applied to their respective surfaces. Alternatively, a suitable glue or adhesive may be used to seal and bond such overlying surfaces together. The term "adherently" as used in this description and in the claims that follow, generally is intended to encompass both thermal and adhesive sealing and bonding of overlying surfaces.

Following construction of the tray-like box as shown in FIG. 9, it is filled with the product to be enclosed in the container, as schematically represented by arrow 238 in FIG. 10. Alternatively, the leak proof cover constructed from the second pre-cut blank 200 may be filled with the product in a similar fashion. If the tray-like box formed from pre-cut blank 100 is filled, FIG. 11 illustrates by means of arrows 242 the manner in which the cover formed from pre-cut blank 200 is folded and sealed over the tray-like box would be placed inside it effectively inverting the container as illustrated in FIG. 11. In any case, the outer surfaces of side flaps 104 and 108 and end flaps 112 and 114 are adherently sealed and secured to the inner surfaces of the corresponding sidewalls 204 and 208 and end walls 212 and 214, except where tab receiver 224 overlies reclosure tab 144. Since it is desired that the overlapping adjacent surfaces of tab receiver 224 and reclosure tab 144 not be adherently secured to each other, these surfaces may be coated with ink or an adhesive to prevent their adherence during the sealing process. In addition, the area proximate reclosure tab 144 may be embossed while the area of reclosure tab 224 is debossed, thereby creating a small space between the juxtaposed adjacent surfaces of these two areas.

The reason that it is undesirable to seal overlying surfaces of tab receiver 224 and reclosure tab 144 will be apparent from FIG. 12, which illustrates the manner in which the consumer gains access to the product enclosed within the container. Referring now to FIG. 12, tab receiver 224 is folded downwardly in the direction indicated by arrow 244, tearing along perforation lines 226 and 228. This action exposes reclosure tab 144. Tab 144 is initially pushed inward as indicated by arrow 246, tearing along perforation line 146. By grasping reclosure tab 144 and the adjacent end of tear open access flap 134 together between the thumb and forefinger of one hand and pulling up while holding down on the corners of first panel 102 with the other hand, the consumer tears open access flap 134 along partially die cut lines 136 and 138, folding back the access flap along fold line 110, as shown in FIG. 13.

After adding butter, water, and/or other seasonings and liquids, access flap 134 can be reclosed by folding it downwardly about scored fold line 110 and inserting reclosure tab 144 into slot 232 as illustrated in FIGS. 14 through 16. Access flap 134 is normally opened prior to initiation of the process for heating the product in an oven, and is then reclosed either for the entire heating process or a portion thereof. Since the instructions for heating the product are imprinted on the upwardly facing surface of first panel 102, they are readily available to the consumer. This is particularly important where the cooking process involves two or more steps, e.g., where the product must first be heated with access flap 134 closed for one time interval at a prescribed microwave oven cooking power level, followed by a second time period with the access flap open —perhaps at a different power level.

The design of access flap 134, reclosure tab 144, and slotted tab receiver 224 provides a relatively tighter seal upon reclosure of access flap 134 than do any of the comparable known prior art designs. Details of this novel reclosure of access flap 134 are best shown in FIGS. 15 and 16. To reclose access flap 134, reclosure tab 144 is fitted into slot 232 and flap 134 is seated in a relatively tight seal against the outer surface of first panel 102 by pushing downwardly on access flap 134 in the area denoted by reference numeral 250. This downward pressure forces the edges of access flap 134 that is adjacent to area 250 into an interference fit with a first and a second shoulder defined by points 140 and 142 that are disposed along fold line 106 where partially die cut lines 136 and 138 terminate at perforation line 146. The friction between the edges of access flap 134 and the first and second shoulders at 140 and 142 helps to hold the flap tightly in place.

The length of slot 232 is selected so that there is an interference fit between its ends and the edges of reclosure tab 144, which edges are angled toward each other. Further, reclosure tab 144 is stressed outwardly as it passes over the top portion of tab receiver 224 and into slot 232, thus increasing the frictional force between contacting surfaces of the tab and the tab receiver. The friction resulting from both sources of interference fit and the friction between reclosure tab 144 and tab receiver 224 all combine to hold access flap 134 closely against the outer surface of first panel 102, providing a relatively tight seal along the areas 248 which extend between partially die cut lines 136 and 138 and which define an area of overlap between the access flap and first panel 102. This seal at 248 acts to prevent steam from escaping the container during the cooking process, thereby reducing the time necessary to heat the enclosed product. In addition, the seal retains product moisture and permits the container to be used for longer storage of a food product after access flap 134 has been opened.

If venting of the steam is required during the heating process, as it may be for certain food products, access flap 134 can be left fully opened, or partially opened (i.e., by not fully seating reclosure tab 144 within slot 232, and by not forcing the portion 250 of access flap 134 which is adjacent to scored fold line 106 into an interference fit with the shoulders at 140 and 142).

A major advantage of the present invention relates to the fact that the filled container can be displayed for sale to the consumer while oriented with second panel 202 facing upwardly. The outer surfaces of first panel 202 and of contiguous end walls 212 and 214 and sidewalls 204 and 208 are normally imprinted with graphics which either photographically or artistically depict the product enclosed within the container. The graphically imprinted surface extends over the upwardly facing portion of the container and around its sides, and is uninterrupted by perforation lines or other irregularities on the surface that might impair the successful marketing of the enclosed food product.

When it is necessary to heat the enclosed product, the container is inverted as shown in FIG. 12, such that the instructions imprinted on the first panel face upwardly and are clearly visible to the consumer throughout the entire heating process. Since the product enclosed within the container is normally in a frozen state from the time that the container is filled, liquids associated with the product are either very viscous or completely frozen, and cannot run out through the corners of the tray-like box, regardless of the orientation of the container. . . so long as the product remains frozen. Of course, when the product is heated, the container must be oriented as shown in FIG. 12 to insure that the leakproof cover formed from pre-cut blank 200 is able to retain the liquids associated with the product.

Although the subject invention has been disclosed with respect to a preferred embodiment, modifications thereto within the scope of the claims will be apparent to those with ordinary skill in the art to which the invention pertains. Accordingly, it is not intended that the invention be limited by the disclosure or by such modifications, but instead that its scope should be determined entirely by reference to the claims which follow hereinbelow.

The embodiments of the invention in which an exclusive property or privilege is claimed are defined as follows:

1. A container for storing a product and holding the product while it is heated in an oven, comprising:

a first panel having an inner surface and an outer surface, and four edges, each defined by a fold line;

a first and a second side flap;

a first and a second end flap;

a second panel having an inner surface and an outer surface, and four edges, each defined by a fold line;

a first and a second sidewall;

a first and a second end wall;

the first panel being connected along different fold lines to each of the first and the second side flaps at two opposite edges of the first panel, and to each of the first and the second end flaps along two other edges of the first panel, the first and second side flaps and end flaps all being folded along the fold lines so that they are generally normal to the inner surface of the first panel and the side flaps being securedly attached to the end flaps to define a tray-like box;

the first panel further including a tear-open access flap defined by a pair of partially die cut lines that extend across the panel in generally parallel alignment to terminate at two spaced apart points disposed along one of the fold lines defining the edges of the first panel, coterminous with ends of a perforation line that defines a reclosure tab disposed on one of the first and second side flaps and the first and second end flaps;

the second panel being connected along different fold lines to each of the first and second sidewalls at opposite edges of the second panel, and to each of the first and second end walls along two other edges of the second panel, the first and second sidewalls and the first and second end walls all being folded along the fold lines so that they are generally normal to the inner surface of the second panel, the first and second end walls being connected to the first and second sidewalls by four gusseted corners that are folded inwardly of the sidewalls and the end walls and adherently secured and sealed in place, the second panel, the first and second sidewalls and end walls, and the gusseted corners together defining a leakproof cover;

the leakproof cover having been fitted over the tray-like box after the container is filled with the product, with an outer surface of the first and second end flaps being adherently secured and sealed to an inner surface of the corresponding first and second end walls, respectively, and an outer surface of the first and second side flaps being adherently secured and sealed to an inner surface of the first and second sidewalls, respectively;

a slotted tab receiver being defined in one of the first and second endwalls and the first and second sidewalls by a pair of perforation lines and a scored fold line, the slotted tab receiver overlying the reclosure tab and including a slot for receiving the reclosure tab upon reclosure of the access flap after it is opened.

2. The container of claim 1 wherein the reclosure tab is disposed on one of the first and the second side flaps, and the partially die out lines extend generally toward the reclosure tab from the fold line connecting the other of the first and the second side flaps to the first panel.

3. The container of claim 1, wherein the reclosure tab is disposed on one of the first and the second end flaps, and the partially die cut lines extend generally toward the reclosure tab from the fold line connecting the other of the first and the second end flaps to the first panel.

4. The container of claim 1, wherein the first and second end flaps and side flaps each include a stiffener flap appended along a fold line that is parallel to the fold line along which they are connected to the first panel, and wherein the stiffener flap is folded inwardly proximate the inner surface of the second panel.

5. The container of claim 1 wherein the two points at which the partially die cut lines terminate define a first and a second shoulder, and wherein the access flap fits between the first and second shoulders in an interference fit upon reclosure after being opened, so that friction between the access flap and the first and second shoulders holds the access flap in close sealing contact with the first panel.

6. The container of claim 1 wherein the perforation line defining the reclosure tab extends from the two points at which the partially die cut lines terminate, along two edges of the reclosure tab that converge, and wherein the slot has a length selected to result in an interference fit with the edges of the reclosure tab when the reclosure tab is inserted into the slot.

7. The container of claim 1 wherein upon reclosure of the access flap after it has been opened, the reclosure tab is subjected to a force directed generally normal to its surface when the reclosure tab is inserted into the slot, the force acting to increase friction between adjacent contacting surfaces of the reclosure tab and the tab receiver.

8. The container of claim 1 wherein the outer surface of the first panel is imprinted with instructions for heating the product, and the outer surface of the second panel is imprinted with graphics and faces downwardly when the container is heated in an oven.

9. In a container for storing a product and for holding the product while it is heated in an oven, the container including a panel connected along fold lines to four sides and a cover, a reclosure system comprising:

a pair of partially die cut lines defining a tear open access flap, one of the pair of partially die cut lines extending over an inner and the outer extending over an outer surface of the panel in generally parallel alignment, the pair of partially die cut lines terminating at two spaced apart points at a fold line connecting one of the sides to the panel;

a perforation line connecting the two spaced apart points, defining a reclosure tab that is disposed on the one side and a tab receiver defined by two perforation lines and a fold line in a side of the cover that overlies the reclosure tab, the tab receiver including a slot.

10. The reclosure system of claim 9 wherein the two spaced apart points define a first and a second shoulder on the fold line, and wherein the access flap fits between the first and second shoulders in an interference fit upon reclosure after being torn open, so that friction between the access flap and the first and second shoulders holds the access flap in close sealing contact with an outer surface of the panel.

11. The reclosure system of claim 9 wherein the container is constructed of paperboard and wherein the paperboard separates between the inner and outer surface of the panel in the area between the partially die cut lines when the access flap is torn open, to define an overlapping seal disposed in the area between the partially die cut lines on both the access flap and the panel.

12. The reclosure system of claim 9 wherein the perforation line defining the reclosure tab extends from the two spaced apart points along two edges of the reclosure tab that converge, and wherein the slot in the tab receiver has a length selected to result in an interference fit with the edges of the reclosure tab when it is inserted into the slot.

13. The reclosure system of claim 9 wherein upon reclosure of the access flap, the reclosure tab is forced outwardly to overlie a portion of the tab receiver as the reclosure tab is inserted into the slot, the resulting stress on the reclosure tab acting to increase friction between adjacent contacting surfaces of the reclosure tab and the tab receiver.

14. The reclosure system of claim 9 wherein upon reclosure of the torn open access flap, the seal closes relatively tightly as the reclosure tab is fitted into engagement with the slot in the tab receiver.

15. The reclosure system of claim 9 wherein to open the container, the perforation lines defining the tab receiver are torn open and the tab receiver is folded outwardly so that the reclosure tab may be forced inwardly by tearing along the perforation line by which it is defined, the access flap then being torn open along the partially die cut lines.

16. A method for assembling from a first and a second pre-cut blank, a container for storing a product and which is adapted to hold the product while it is heated in an oven, the first pre-cut blank including two end flaps and two side flaps defined respectively along opposite ends and opposite sides of a first panel by scored fold lines, the first panel including a tear open access flap defined by a pair of generally parallel partially die cut lines that extend across the first panel in a generally converging direction toward two spaced apart points disposed on one of the scored fold lines defining one of the two side flaps and two end flaps, coterminous with the ends of a perforation line that defines a reclosure tab disposed on the flap; the second pre-cut blank including two end walls, and two sidewalls corresponding respectively to the side flaps and end flaps and defined respectively along opposite sides and opposite ends of a second panel by scored fold lines, the end walls being connected to the sidewalls by four gusseted corners, one of the two sidewalls and two end walls that corresponds to the one flap including a slotted tab receiver defined by two perforated lines and a scored fold line, the method comprising the steps of:

folding the end flaps and side flaps along the scored fold lines so that they are substantially normal to an inside surface of the first panel, and securing them in that position, forming a tray-like box;

folding the end walls and sidewalls along the scored fold lines so that they are substantially normal to an inside surface of the second panel and folding the gusseted corners inside;

adherently sealing the gusseted corners in place, forming a substantially leakproof cover;

after filling one of the tray-like box and leakproof cover with the product, inserting the leakproof cover onto the tray-like box so that the inside of the second panel faces toward the product, with the slotted tab receiver overlying the reclosure tab; and adherently sealing and securing the outer surfaces of the end flaps and the side flaps to the inner surfaces of the corresponding end walls and sidewalls, except where the slotted tab receiver overlies the reclosure tab.

17. The method of claim 16 further comprising the step of embossing the reclosure tab on the first blank and debossing a similar area proximate the slotted tab receiver on the second blank to prevent adherence between the slotted tab receiver and the reclosure tab during the step of adherently sealing and securing.

18. The method of claim 16 wherein the two spaced apart points define a first and a second shoulder and wherein the access flap fits between the first and second shoulders in an interference fit upon reclosure after being opened, so that friction between the access flap and the first and second shoulders acts to hold the access flap in close sealing contact with the first panel.

19. The method of claim 16 wherein the slotted tab receiver includes a slot having a length sized to produce an interference fit with the reclosure tab so that upon insertion of the reclosure tab into the slot to reclose the access flap, friction between the reclosure tab and the slot tends to hold the access flap in close sealing contact with the first panel.

* * * * *